United States Patent [19]

LaRocca

[11] Patent Number: 4,947,754

[45] Date of Patent: Aug. 14, 1990

[54] SYSTEM AND METHOD FOR PENETRATING ORBITING TARGETS

[75] Inventor: Edward W. LaRocca, Placentia, Calif.

[73] Assignee: General Dynamics Corporation, Pomona Division, Pomona, Calif.

[21] Appl. No.: 396,774

[22] Filed: Aug. 18, 1989

Related U.S. Application Data

[63] Continuation of Ser. No. 130,858, Dec. 10, 1987, abandoned.

[51] Int. Cl.[5] ..... F42B 15/24

[52] U.S. Cl. ..... 102/489; 102/491; 102/501; 89/1.11

[58] Field of Search ..... 102/491–497, 102/501, 502, 430, 448, 489; 89/1.11

[56] References Cited

U.S. PATENT DOCUMENTS

| | | | |
|---|---|---|---|
| 136,468 | 4/1973 | Tooth | 102/432 |
| 2,343,818 | 3/1944 | Sweeley | 102/494 |
| 3,463,637 | 8/1969 | Foerster | 102/501 |
| 3,664,824 | 5/1972 | Meadus et al. | 75/.5 R |
| 3,804,019 | 4/1979 | Hurley | 102/448 |
| 4,027,594 | 7/1977 | Olin et al. | 102/501 |
| 4,038,786 | 8/1977 | Fong | 51/320 |
| 4,170,330 | 10/1979 | Hertzberg | 244/3.13 |
| 4,175,493 | 11/1979 | Daily | 102/532 |
| 4,388,869 | 6/1983 | Edleson | 102/494 |
| 4,508,036 | 4/1985 | Jensen et al. | 102/501 |

OTHER PUBLICATIONS

*The World Book Encyclopedia,* 1958, vol. 11, p. 5273.

Fusion Fuel Pellet Injection with a Railgun, Hawke J. Vac. Sci. Technol A 1(2) Apr.–Jun. 1983, pp. 969–973.

*Primary Examiner*—Harold J. Tudor

*Attorney, Agent, or Firm*—Neil F. Martin; Leo R. Carroll

[57] ABSTRACT

Self-dissipating projectiles for use in anti-satellite weapons or warheads are made from suitable solid materials capable of sublimation after relatively short periods of time at the low pressures found in outer space. The material is suitably a volatile organic compound such as naphthalene, paradibromobenzene, benzoic acid, or similar compounds which change directly from the solid to the gaseous phase without becoming liquid.

4 Claims, 1 Drawing Sheet

SYSTEM AND METHOD FOR PENETRATING ORBITING TARGETS

This is a continuation of application Ser. No. 07/130,858, filed Dec. 10, 1987, now abandoned.

BACKGROUND OF THE INVENTION

The present invention relates to projectiles or fragments suitable for use in outer space in anti-satellite weapons or warheads.

Conventional projectiles normally used in weapons, for example gunshot or cartridges, are commonly made of metal such as lead. Warheads typically contain a plurality of metallic fragments for firing at a target. Metal projectiles of this type are not suitable for use in outer space, for example in anti-satellite weapons or warheads, since the projectiles or metallic fragments may stay in orbit and remain in space for unknown periods of time, presenting threats to other orbiting objects such as friendly satellites.

SUMMARY OF THE INVENTION

It is an object of the present invention to provide projectiles, suitable for use in weapons against orbiting targets, which will not subsequently pose a threat to other orbiting objects.

According to the present invention, a method of penetrating an orbiting target is provided which comprises the steps of conveying a plurality of pellets into outer space in a warhead, the pellets being of a material capable of subliming under typical outer space conditions, and releasing the pellets from the warhead into the path of a selected orbiting target such that the relative velocity between the target and the pellets is sufficient for the pellets to penetrate the target on impact.

The projectiles or pellets are self-dissipating after impact, the projectiles being made from a solid, volatile organic compound which is capable of sublimation at the low pressures found in outer space. Suitable materials for the projectiles include naphthalene, benzoic acid and paradibromobenzene, and similar materials.

These materials have the property of changing directly from the solid to the gaseous phase without becoming a liquid, in a similar fashion to the commonly known mothballs, and where in mothballs the transition takes several months at ambient pressures, it will occur within minutes when the projectiles are released in outer space.

These projectiles, although of relatively low strength, will be able to penetrate "soft" targets in space, such as the aluminum sheet material typical of the support structures of solar panels and satellite exterior components, in view of the very high orbiting velocity of such targets. Thus, if a plurality of the projectiles were released or fired from a suitably hermetically sealed container in the path of a target, they would be able to penetrate and damage the target and then vaporize and dissipate into space so that no residual fragments would remain in orbit to damage other objects at a later time. The dissipation would typically take place within minutes. The solid projectile materials would be able to survive launch and impact stresses by housing them in a warhead which is hermetically sealed or airtight.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
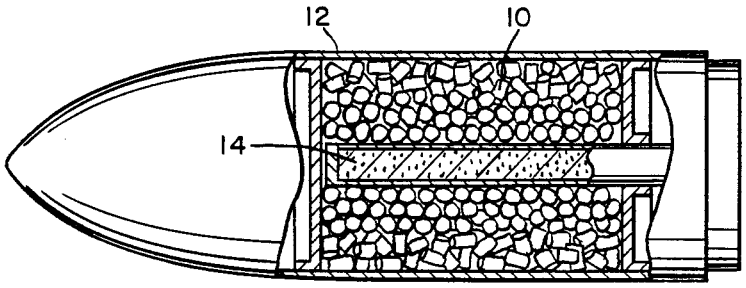
FIG. 1 is a side elevation view, partially cut away, of a typical missile or warhead containing the pellets and releasing means.

As illustrated in FIG. 1 of the drawings, pellets 10 of a material capable of subliming under outer space conditions are sealed in a standard warhead container 12. The container is hermetically sealed in any standard fashion as is commonly done in space vehicles. A standard warhead release mechanism 14 such as a bursting charge is contained within the warhead.

Figure 2:
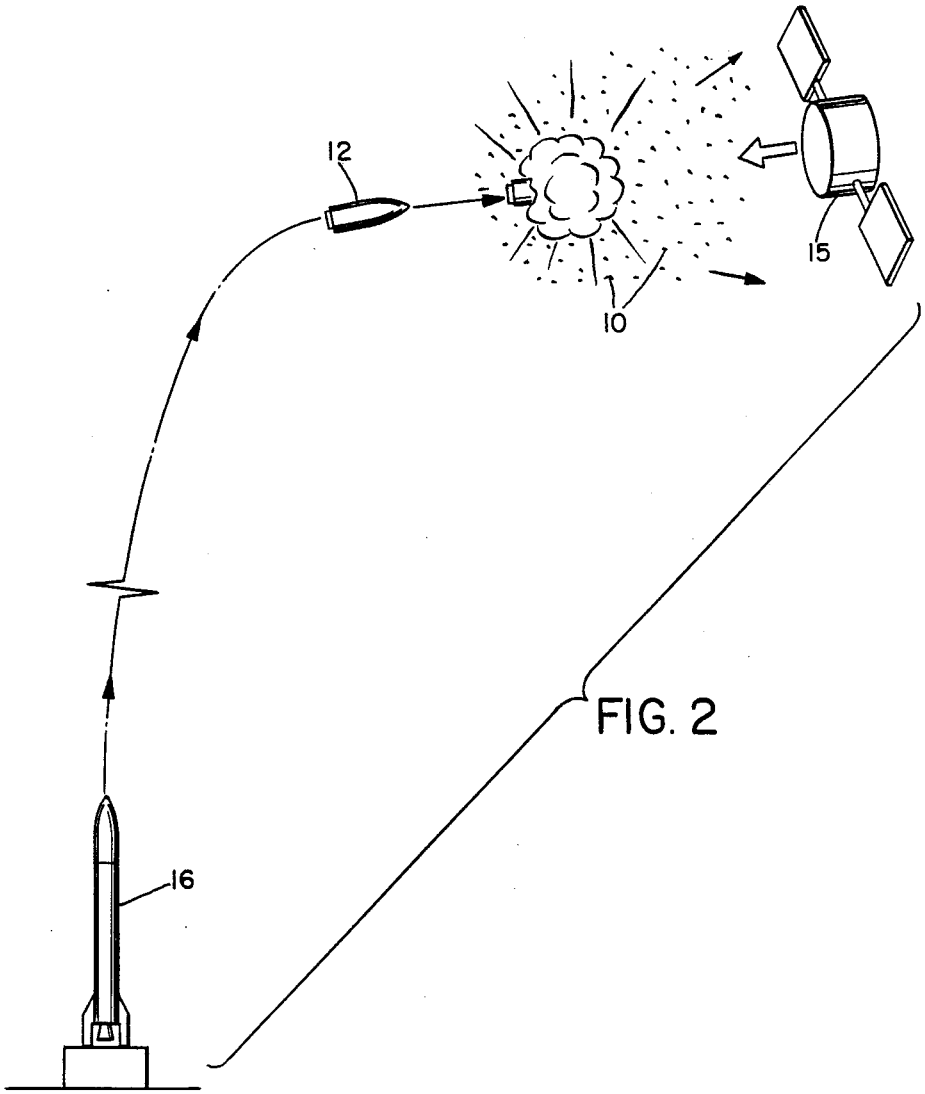
FIG. 2 illustrates a typical launch target intercept and pellets release sequence according ot a preferred embodiment of the present invention.

FIG. 2 of the drawings illustrates a typical launch sequence for propelling the warhead 12 into outer space and into the path of an orbiting satellite 15 or other object. The warhead 12 is launched via a booster rocket 16 in the standard fashion, and is propelled into the path of the target, where the bursting charge or other release mechanism is activated in order to release the pellets 10 into the path of the target 15. The orbiting target will be traveling at sufficient speed, typically in the range from 2765 feet per second to 4151 feet per second, to impact the pellets with sufficient force for the pellets to penetrate and damage the target. Shortly after impact, any remaining pellets or pellet fragments will vaporize and dissipate into space, so that no residual fragments will remain in space to damage other, potentially friendly targets.

The projectiles or pellets 10 may be cast or pressed to any desired shape and fired from any suitable container. The following examples are illustrative of materials suitable for use in the invention, although it will be understood by those skilled in the field that other similar materials may be used which have the property of sublimation at low pressure and sufficient structural integrity over short time periods of several seconds to be suitable for use in a projectile weapon. The projectiles must be able to survive launch and impact stresses, for example, while dissipating or subliming into the gaseous phase shortly after impact.

EXAMPLE 1

In this example, paradibromobenzene was pressed into pellet-like projectiles or fragments comprising cylinders of ½ inch diameter and 7/10 inches in length. The material was compacted towards the upper limits of density to provide a hardness and structural integrity at or approaching the maximum possible for such a material. In an alternative, ½ inch diameter spheres of the same material were cast The pressed or cast cylinders and spheres were fired from smooth bore guns at velocities ranging from 2765 feet per second to 4151 feet per second at aluminum sheet targets. Aluminum sheets to 0.156 inches thick were penetrated by the projectiles with enough residual energy to damage a 0.051 inch thick witness plate stationed 4 inches away from the first sheet.

This shows that these projectiles would be able to penetrate and damage conventional aluminum satellite support structures and exterior components if released or fired from a suitable container or warhead in outer space into the path of an orbiting target, which would impact the projectiles at speeds in the tested range. The projectiles or fragments need not be cylindrical or spherical in shape, but may comprise fragments of any suitable regular or irregular shape. The rounded shape is chosen for testing purposes since it is optimal for testing by firing from smooth bore guns.

EXAMPLE 2

In this example the projectiles were of substantially the same shape and dimensions as in Example 1, but the material used was naphthalene. Naphthalene may be cast at approximately 80 degrees Centigrade or pressed into suitable density and size fragments or projectiles.

EXAMPLE 3

In this example the projectiles were of benzoic acid having substantially the same shape and dimensions as in Example 1.

Other examples of normally solid volatile organic materials which are within the scope of the present invention and suitable for forming self-dissipating projectiles will be apparent to those skilled in the art from the above description and specific examples. Any solid material capable of sublimation at low pressures as found in outer space within a relatively short time period, and also having the capability of maintaining structural integrity over a short time period of the order of several seconds between firing and impact with a target, may be used for the projectiles. The material selected can be cast or pressed in a standard fashion into any desired small projectile-like shape and fired from guns at suitable targets to test its capability to inflict damage on satellites or other orbiting targets.

Although some specific examples of the present invention have been listed above, alternatives will be apparent to those skilled in the art and the scope of the invention is not limited to these specific examples but is defined by the appended claims.

I claim:

1. A projectile system for penetrating an orbiting target, comprising:

a container;

a plurality of pellets in said container, said pellets being of a material capable of subliming under predetermined outer space operating conditions;

transport means for transporting said container into outer space into the path of an orbiting target; and release means for releasing the pellets in the path of the moving target such that the relative velocity between the pellets and the target is sufficient for the pellet to penetrate the target on impact.

2. The system as claimed in claim 1 wherein the material is selected from the group consisting of: napthalene, paradibromobenzene, and benzoic acid.

3. The system as claimed in claim 1 wherein the material is a volatile organic compound.

4. A method of penetrating an orbiting target in outer space comprising the steps of:

conveying a plurality of pellets into outer space in a warhead to a predetermined location, the pellets being of a material capable of subliming under typical outer space conditions; and releasing the pellets from the container into the path of a selected orbiting target such that the relative velocity between the target and the pellets is at least sufficient for the pellets to penetrate the target on impact.

* * * * *